US008064806B2

(12) United States Patent
Nishiwaki et al.

(10) Patent No.: US 8,064,806 B2
(45) Date of Patent: Nov. 22, 2011

(54) IMAGE FORMING DEVICE HAVING A DEVELOPING MATERIAL CASE WITH A MOVING VIBRATING REGION

(75) Inventors: Kenjiro Nishiwaki, Aichi (JP); Masataka Maeda, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 363 days.

(21) Appl. No.: 12/236,163

(22) Filed: Sep. 23, 2008

(65) Prior Publication Data

US 2009/0080942 A1 Mar. 26, 2009

(30) Foreign Application Priority Data

Sep. 26, 2007 (JP) ..... 2007-249122

(51) Int. Cl.
*G03G 15/08* (2006.01)

(52) U.S. Cl. ..... 399/261; 399/222

(58) Field of Classification Search ..... 399/222, 399/261, 289–295
See application file for complete search history.

(56) References Cited

U.S. PATENT DOCUMENTS 4,527,884 A * 7/1985 Nusser ..... 399/266
6,215,974 B1 * 4/2001 Katoh et al. ..... 399/258

FOREIGN PATENT DOCUMENTS

JP 61-73167 4/1986

* cited by examiner

*Primary Examiner* — David Gray
*Assistant Examiner* — G. M. Hyder
(74) *Attorney, Agent, or Firm* — Scully, Scott, Murphy & Presser, PC

(57) ABSTRACT

There is provided an image forming device, including an image holding unit configured to hold an image formed by developing material, a developing material case configured to accommodate the developing material and to have a supplying opening facing the image holding unit, a carrying unit having a plurality of carrying electrodes, the carrying unit being configured to carry the developing material accommodated in the developing material case toward the image holding unit by generating a traveling electric field through the plurality of carrying electrodes, at least one vibrator that vibrates the carrying unit, and a vibrating region moving unit configured to move a vibrating region vibrated by the at least one vibrator along the carrying unit in accordance with an amount of the developing material in the developing material case.

16 Claims, 11 Drawing Sheets

IMAGE FORMING DEVICE HAVING A DEVELOPING MATERIAL CASE WITH A MOVING VIBRATING REGION

REFERENCE TO RELATED APPLICATION

This application claims priority under 35 U.S.C. §119 from Japanese Patent Application No. 2007-249122, filed on Sep. 26, 2007. The entire subject matter of the application is incorporated herein by reference.

BACKGROUND

1. Technical Field

Aspects of the present invention relate to an image forming device having a function of generating a traveling electric field for carrying developing material.

2. Related Art

In general, a developing material carrying device which carries developing material through a traveling electric field is provided with a carrying body having a plurality of line-like electrodes aligned in a line. In the developing material carrying device, a traveling electric field is generated by successively applying a polyphase alternating voltage to the electrodes of the carrying body to carry charged developing material.

However, such a developing material carrying device has a drawback that the developing material agglutinates on the carrying body. If such a phenomenon occurs, the developing material can not be carried smoothly.

Japanese Patent Provisional Publication No. SHO 61-73167 (hereafter, referred to as JP SHO 61-73167A) discloses an example of a developing material carrying device provided with a vibrator fixed to at a certain position in the developing material carrying device to cause a vibrating motion at a certain position of a carrying unit. Such a configuration of the developing material carrying device makes it possible to vibrate the entire carrying unit and thereby to collapse the agglutinated developing material by applying the vibration to the certain position of the carrying unit.

SUMMARY

Incidentally, if the carrying unit is arranged in a slanting direction to carry the developing material in a slanting direction, the developing material is carried sequentially by the carrying unit such that a part of the developing material (hereafter, referred to as a picking up part) situated, closely to the carrying unit, on the top surface of the developing material is carried first. In this case, if the developing material agglutinates in the picking up part, it becomes difficult to smoothly carry the developing material.

Regarding the configuration of the developing material carrying device disclosed in JP SHO 61-73167A, because the vibrator is fixed at the certain position, the picking up part of the developing material may shift from the vibrator when the position of the top surface of the developing material moves depending on the amount of toner in a developing material case. If such a situation occurs (i.e. if the picking up part of the developing material shifts from the vibrator), it becomes difficult to propagate the vibration produced by the vibrator to the picking up part of the developing material. As a result, the developing material may agglutinate in the picking up part, and thereby the above described problem is caused.

Aspects of the present invention are advantageous in that at least one of a developing material carrying device and an image forming device capable of preventing the developing material from agglutinating at a picking up part on a carrying unit and thereby carrying smoothly the developing material is provided.

According to an aspect of the invention, there is provided an image forming device, comprising: an image holding unit configured to hold an image formed by developing material; a developing material case configured to accommodate the developing material and to have a supplying opening facing the image holding unit; a carrying unit having a plurality of carrying electrodes, the carrying unit being configured to carry the developing material accommodated in the developing material case toward the image holding unit by generating a traveling electric field through the plurality of carrying electrodes; at least one vibrator that vibrates the carrying unit; and a vibrating region moving unit configured to move a vibrating region vibrated by the at least one vibrator along the carrying unit in accordance with an amount of the developing material in the developing material case.

Such a configuration makes it possible to move the vibrating region to be situated at a position corresponding to a developing material picking up part (from which the developing material is carried by the carrying unit). Consequently, it is possible to effectively prevent the developing material from agglutinating on the carrying unit.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMS, flash memory, EEPROMs, CD-media, DVD-media, temporary storage, hard disk drives, floppy drives, permanent storage, and the like.

BRIEF DESCRIPTION OF THE ACCOMPANY DRAWINGS

DETAILED DESCRIPTION

Hereafter, embodiments according to the invention will be described with reference to the accompanying drawings.

First Embodiment

Figure 1:
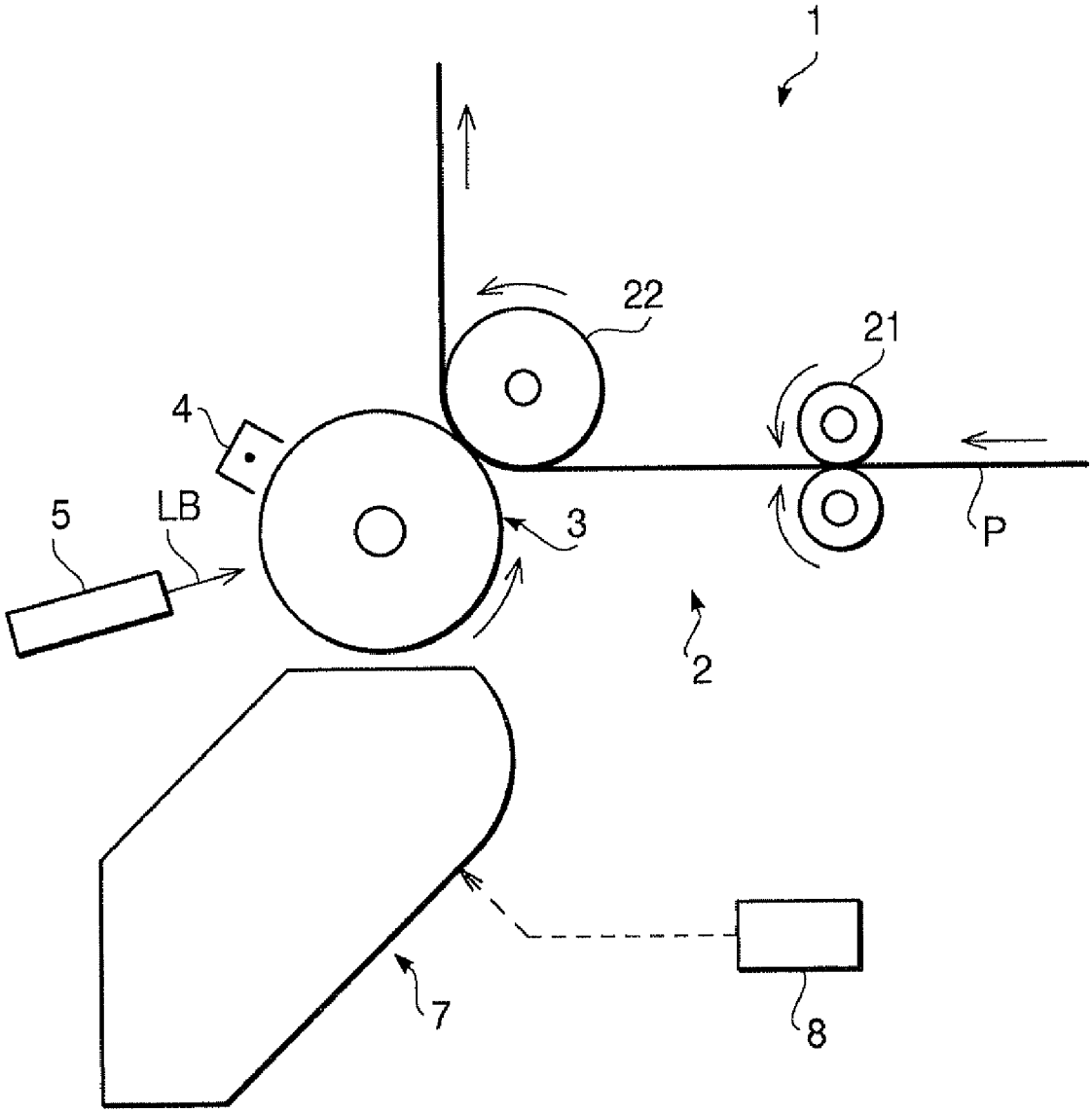
FIG. 1 is a side view illustrating a general internal configuration of a laser beam printer functioning as an image forming device according to a first embodiment.
Figure 2:
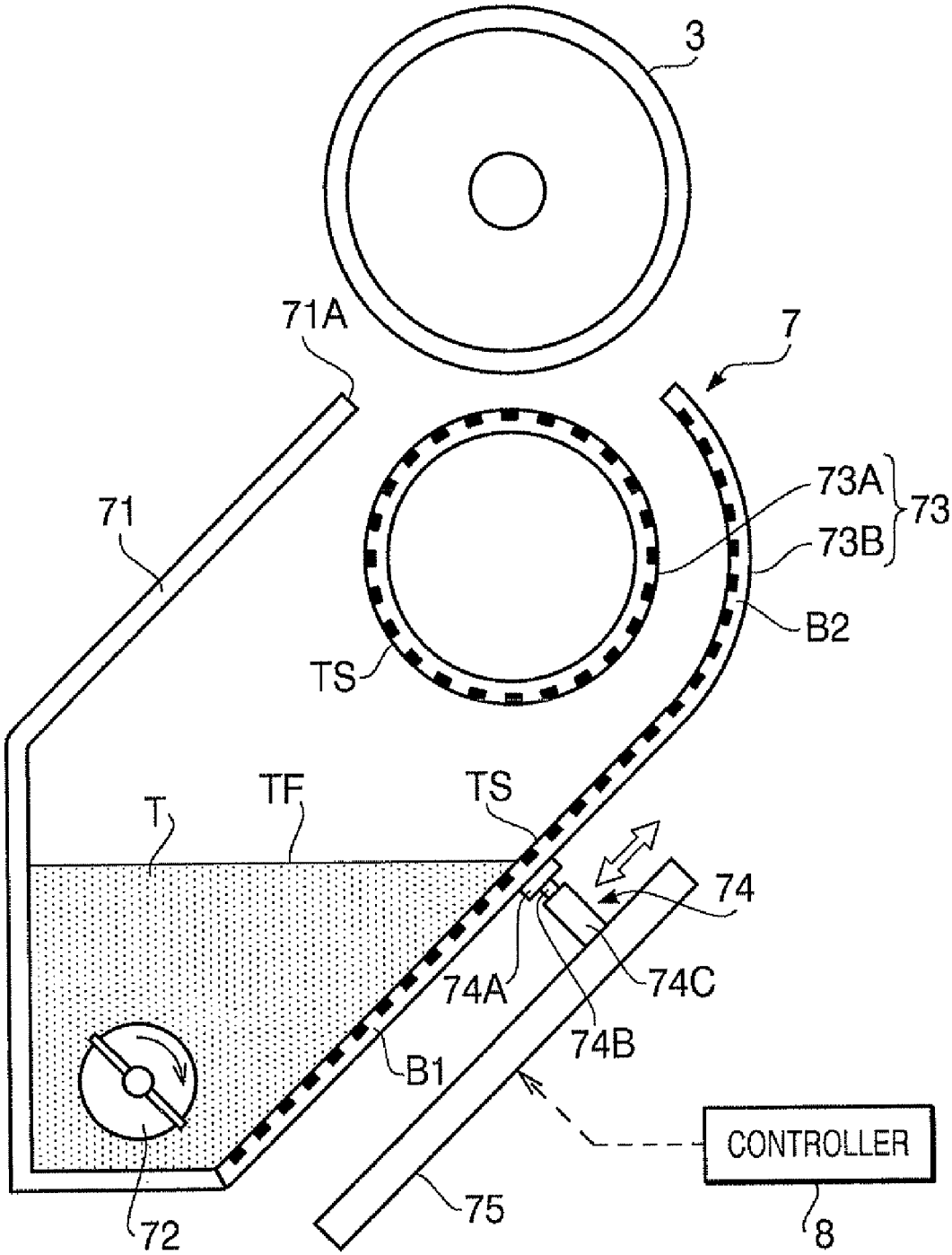
FIG. 2 is a side cross section illustrating an internal structure of a toner supplying device in the laser beam printer.

FIG. 1 is a side view illustrating a general internal configuration of a laser beam printer 1 functioning as an image forming device according to a first embodiment. FIG. 2 is a side cross section illustrating an internal structure of a toner supplying device 7.

As shown in FIG. 1, the laser beam printer 1 includes a paper carrying mechanism 2, a photosensitive drum 3 functioning as an image holding unit, a charger 4, a scanning unit 5, the toner supplying device 7, and a controller 8. In FIG. 1, other components, such as a paper supply tray and a fixing unit, are omitted for the sake of simplicity.

The paper carrying mechanism 2 carries a sheet of paper P supplied from the paper supply tray. The paper carrying mechanism 2 includes a plurality of rollers (e.g. a registration roller 21) for carrying the paper 2 to a transferring position of the photosensitive drum 3.

A developing process is executed as follows. After an outer circumferential surface of the photosensitive drum 3 is negatively charged by the charger 4 uniformly, the negatively charged outer circumferential surface of the photosensitive drum 3 is scanned by a high-speed scanning laser beam LB from the scanning unit 5. Since the potential of scanned part of the outer circumferential surface of the photosensitive drum 3 changes, a latent image is formed on the outer circumferential surface of the photosensitive drum 3.

Next, toner T (i.e., developing material) is supplied from the toner supplying device 7 to the latent image on the photosensitive drum 3. In other words, the toner T is supplied selectively toward the outer circumferential surface of the photosensitive drum 3. Consequently, a toner image is formed on the photosensitive drum 3.

Subsequently, the photosensitive drum 3 and a transfer roller 22 are rotated to carry the paper P while sandwiching the paper P therebetween. Since at this time the toner image held on the outer circumferential surface of the photosensitive drum 3 is attracted by the transfer roller 22, the toner image is transferred from the photosensitive drum 3 to the paper P.

As shown in FIG. 2, the toner supplying device 7 includes a cartridge case 71, an agitator 72, a toner carrying unit 73, a vibrator 74 and a moving unit 75. The cartridge case 71 is made of material having a relatively high degree of rigidity, such as resin. A part of a wall of the cartridge case 71 is formed as the toner carrying unit 73. A supply opening 71A is formed at the upper part of the cartridge case 71 to face the photosensitive drum 3. The cartridge case 71 accommodates the toner T in the bottom part thereof. The toner T is non-magnetic single-component toner having a negative electrostatic property. That is, the toner T is charged negatively. For example, the toner T is toner containing polyester as a major constituent.

The agitator 72 is provided at the deepest part in the cartridge case 71 to be rotatable to agitate the toner T accumulated in the cartridge case 71. By agitating the toner T, the toner T can be negatively charged due to, for example, friction between particles of the toner T or friction between the toner T and the toner carrying unit 73.

Figure 3A:
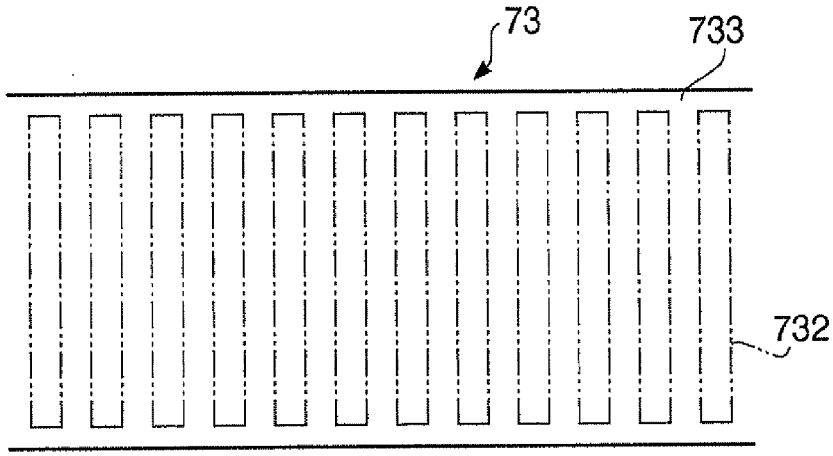
FIG. 3A is a plan view of a toner carrying unit.
Figure 3B:
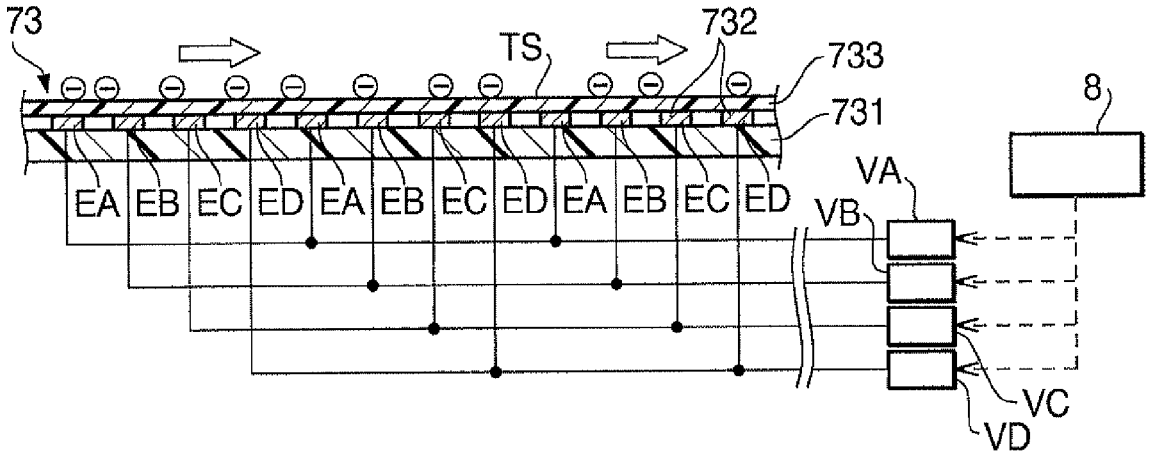
FIG. 3B is a cross section of the toner carrying unit.

FIG. 3A is a plan view of the toner carrying unit 73. FIG. 3B is a cross section of the toner carrying unit 73. As shown in FIG. 3B, the toner carrying unit 73 includes a support plate 731, a plurality of carrying electrodes 732 arranged on the support plate 731, a coating 733 which covers the support plate 731 on the side on which the carrying electrodes 732 are formed. For example, the coating 733 is a coating film made of nylon (resin). In FIG. 3B, a surface of the coating 733 is represented as a carrying surface TS on which the toner T is carried. The toner carrying unit 73 formed to be a thin plate has a lower degree of rigidity than that of the cartridge case 71 so that the toner carrying unit 73 has a property of being vibrated more easily.

As shown in FIG. 3A, each of the carrying electrodes 732 is a linear pattern made of a thin metal film extending in a direction perpendicular to a carrying direction of the toner T. In other words, each carrying electrode 732 extends in a direction of an axis of the photosensitive drum 3. The carrying electrodes 732 are arranged, at constant intervals in the carrying direction of the toner T, in parallel with each other.

The carrying electrodes 732 are connected to a first feeder VA, a second feeder VB, a third feeder VC and a fourth feeder VD which supply voltages having different phases. More specifically, the carrying electrodes 732 are connected to the first feeder VA, the second feeder VB, the third feeder VC and the fourth feeder VD repeatedly in this order from the upstream side. In other words, in the arrangement of the carrying electrodes 732, electrodes connected to the same feeder (VA, VB, VC or VD) are arranged at intervals of four electrodes as illustrated in FIG. 3B. In the following, the carrying electrodes 732 connected to the first feeder VA are referred to as "carrying electrodes EA", the carrying electrodes 732 connected to the first feeder VB are referred to as "carrying electrodes EB", the carrying electrodes 732 connected to the first feeder VC are referred to as "carrying electrodes EC", and the carrying electrodes 732 connected to the first feeder VD are referred to as "carrying electrodes ED" for the sake of convenience.

Figure 4:
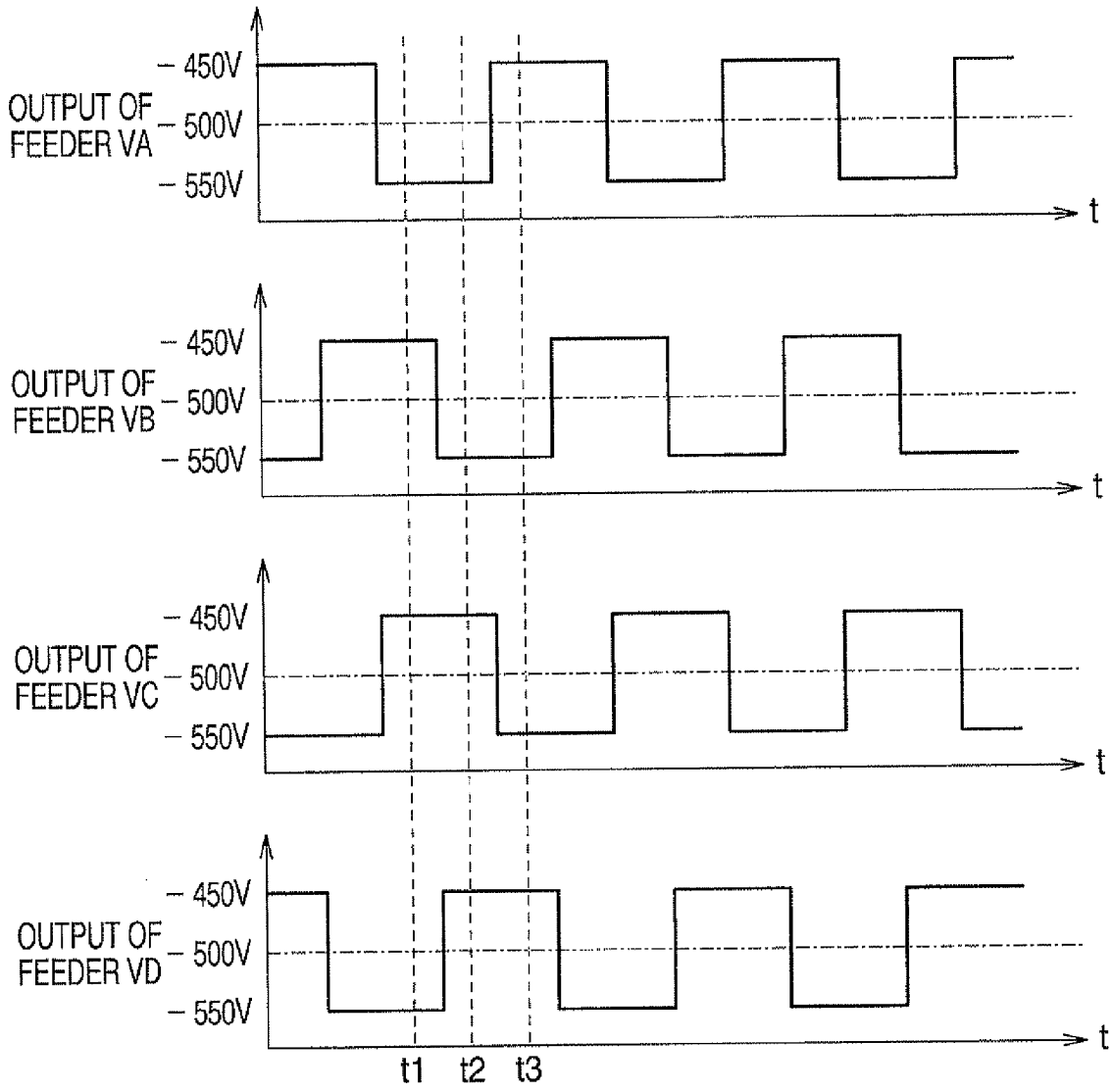
FIG. 4 illustrates waveforms of output voltages of first to fourth feeders.

FIG. 4 illustrates waveforms of output voltages of the first to fourth feeders VA, VB, VC and VD, respectively. Under control of the controller 8, the first to fourth feeders VA, VB, VC and VD respectively outputs the voltages shown in FIG. 4. More specifically, the waveforms of the output voltages of the feeders VA, VB, VC and VD have the same shape, but phases of the waveforms are shifted with respect to each other at intervals of 90 degrees. By thus applying the waveforms from the first to fourth feeders VA, VB, VC and VD to the carrying electrodes 732, a traveling voltage can be applied to the carrying electrodes 732. Consequently, a traveling electric field can be generated on the carrying surface TS.

Figure 6A:
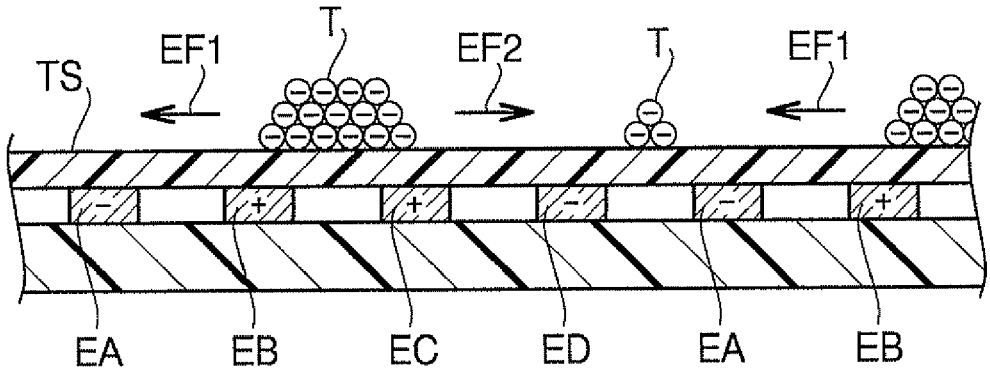
FIG. 6A illustrates condition of toner being carried on a carrying surface at time t1.

In the following, the voltage of −550V is represented as a negative voltage with respect to the intermediate voltage of −500V and the voltage of −450V is represented as a positive voltage with respect to the intermediate voltage of −500V. As shown in FIG. 4, at the time t1, the negative voltage is output from each of the first and fourth feeders VA and VD and the positive voltage is output from each of the second and third feeders VB and VC. FIG. 6A illustrates the condition of the toner T on the carrying surface TS at the time t1.

As shown in FIG. 6A, an electric field EF1 having a direction (indicated by an arrow EF1) opposite to the carrying direction of the toner T is generated between the negative carrying electrode EA and the positive carrying electrode BB, and an electric field EF2 having a direction (indicated by an arrow EF2) equal to the carrying direction of the toner T is generated between the positive carrying electrode EC and the negative carrying electrode ED. In this case, a large amount of negative toner T is collected around the positive carrying electrodes EB and EC, and a small amount of toner T which was not able to move to the positive carrying electrodes EB and DC remains between the negative carrying electrodes ED and EA.

Figure 6B:
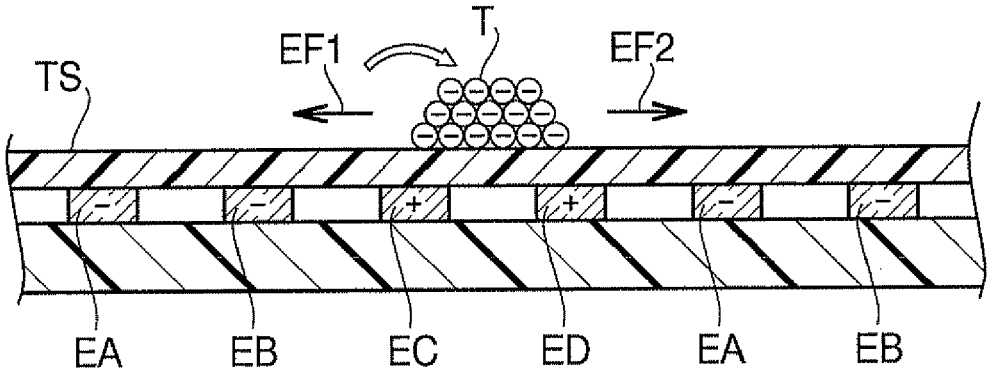
FIG. 6B illustrates condition of toner being carried on the carrying surface at time t2.

As shown in FIG. 4, at the time t2, the negative voltage is output from each of the first and second feeders VA and VB, and the positive voltage is output from each of the third and fourth feeders VC and VD. FIG. 6B illustrates the condition of the toner T on the carrying surface TS at the time t2. As shown in FIG. 6B, since the electric field EF1 is generated between the negative carrying electrode EB and the positive carrying electrode EC, the toner T which was situated around the carrying electrodes EB and EC at the time t1 moves to the carrying electrodes EC and ED which are now in a positive voltage state.

Figure 6C:
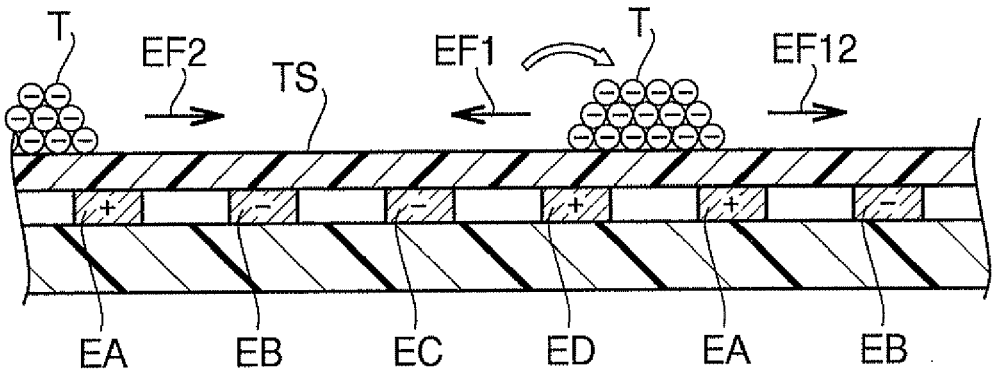
FIG. 6C illustrates condition of toner being carried on the carrying surface at time t3.

FIG. 6C illustrates the condition of the toner T on the carrying surface TS at the time t3. As shown in FIG. 6C, the electric field EF1 is generated between the negative carrying electrode EC and the positive carrying electrode ED. Therefore, the toner T which was situated around the carrying electrodes BC and ED at the time t2 moves to the carrying electrodes ED and EA which are now in a positive voltage state. By repeating the above described voltage controls shown in FIGS. 6A, 6B and 6C, the toner T is carried along the carrying surface TS.

As shown in FIG. 2, the toner carrying unit 73 includes a first carrying unit 73A which is provided in the cartridge case 71 and has a form of a cylinder, and a second carrying unit 73B having a shape of a curved plate to form a part of the wall of the cartridge case 71. More specifically, the second carrying unit 73B includes a tilting part B1 which extends, in a slanting direction, upwardly from the bottom of the cartridge case 71, and a cylindrical part B2 which is formed to face the first carrying unit 73A and to form the supply opening 71A at the top edge thereof. In the toner carrying unit 73 configured as above, the toner T accumulated in the bottom part of the cartridge case 71 is carried upwardly in a slanting direction along the tilting part B1 of the second carrying unit 73B, and then is carried between the first carrying unit 73A and the cylindrical part B2 of the second carrying unit 73B toward the photosensitive drum 3.

If a latent image is formed on the photosensitive drum 3, the toner T which has moved to the supply opening 71A is attracted by the latent image on the photosensitive drum 3 and thereby moves to the photosensitive drum 3. On the other hand, if no latent image formed on the photosensitive drum 3, the toner T passes by the photosensitive drum 3 and thereby is carried successively along the first carrying unit 73A until the voltage supply to the first carrying unit is terminated.

Figure 5A:
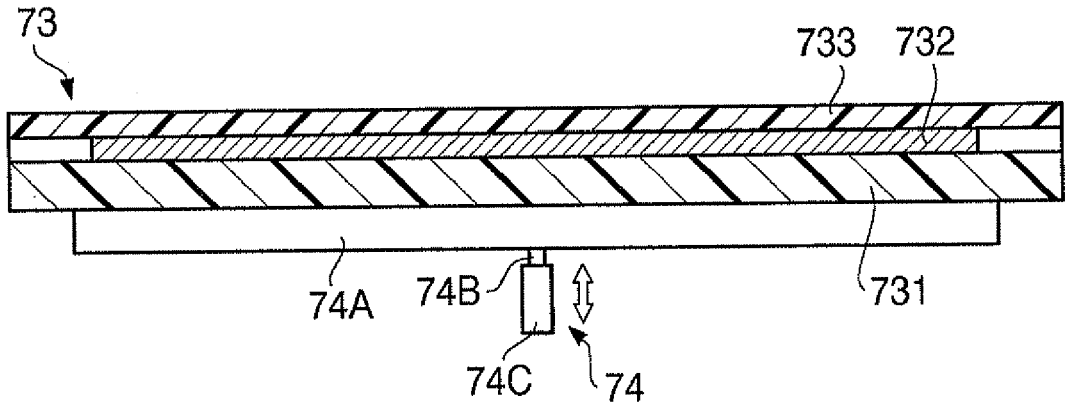
FIG. 5A is a front view illustrating a configuration of a vibrator.

FIG. 5A is a front view illustrating a configuration of the vibrator 74. The vibrator 74 includes a beam-like member 74A mounted to be slidable with respect to the toner carrying unit 732, a coil 74B fixed at the center of the beam-like member 74A, and a core 74C which vibrates the coil 74B in an axial direction of the core 74C.

As shown in FIGS. 2 and 5A, the beam-like member 74A is a rectangular member extending in parallel with the carrying electrode 732, and is made of material having a higher degree of rigidity than the toner carrying unit 73. The beam-like member 74A may have various types of lengths. Preferably, the length of the beam-like member 74A is larger than or equal to the longer side of the carrying electrode 732. With this configuration, it becomes possible to collapse the toner T when agglutinated on the carrying electrodes 732.

Figure 5B:
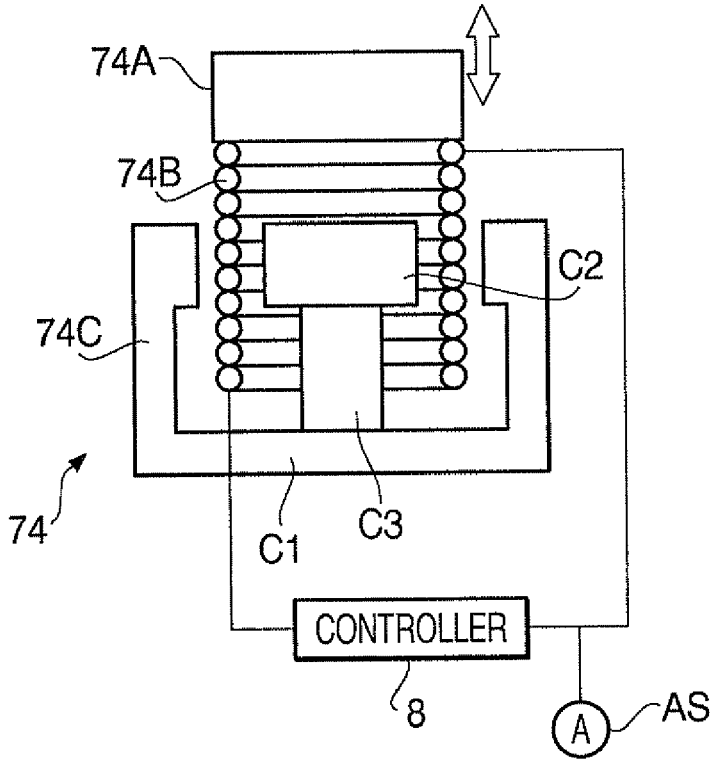
FIG. 5B is a cross section illustrating the configuration of the vibrator.

As shown in FIG. 5B, the coil 74B is provided such that one end of the coil 74B is fixed to the beam-like member 74A and the other end is situated in the inside of the core 74C. To the coil 74B, an alternating voltage is supplied from the controller 8. That is, voltages having opposite polarities are alternately applied to the coil 74B. Consequently, magnetic fields having opposite polarities are generated from the coil 74B.

Between the coil 74B and the controller 8, a current sensor AS for detecting the current flowing through the coil 74B is provided. The current sensor AS outputs a signal representing the intensity of the detected current. The signal generated by the current sensor AS is sent to the controller 8. More specifically, when the moving amount of the coil 74B changes due to change of the load acting on the coil 74B being vibrated with respect to the core 74C, the current flowing through the coil 74B also changes, and thereby the change of the current is detected by the current sensor AS.

In this embodiment, the load acting on the coil 74B changes in response to change of the amount of toner T accommodated in the cartridge case 71. More specifically, when top surface of the accumulated toner T is at a position which is the same position on the toner carrying unit 73 as the position of the vibrator 74, the load acting on the coil 74B increases. On the other hand, when the top surface TF of the toner T is lower than the position of the vibrator 74, the load acting on the coil 74B decreases.

When the load acting on the coil 74B increases, the current flowing through the coil 74B also increases. On the other hand, when the load acting on the coil 74B decreases, the current flowing through the coil 74B also decreases. Therefore, the controller 8 is able to estimate the position of the top surface TF of the toner T.

As shown in FIG. 5B, the core 74C includes a cylinder-shaped outer core part C1 having a bottom surface, an inner core part C2 arranged in the inside of the outer core part C1 to have a predetermined gap with respect to the outer core part C1, and a permanent magnet part C3 provided between the bottom surface of the outer core part C1 and the inner core part C2. In this structure of the core 74C, a magnetic field is generated from the gap. Therefore, when an alternating voltage is applied to the coil 74B placed in the magnetic field, the coil 74B receives an alternating force in the axial direction by Fleming's left-hand rule. Consequently, the coil 74B vibrates with respect to the core 74C.

As shown in FIG. 2, the moving unit 75 supports the core 74C of the vibrator 74 in such a manner that the vibrator 74 is slidable along the tilting part B13 of the second toner carrying unit 73B. That is, the moving unit 75 moves the vibrator 74 in a direction in which the toner T is carried. For example, a moving mechanism including a rail, wheels and a motor, or a moving mechanism including a rack, a pinion and a motor may be employed as the moving unit 75.

Figure 7:
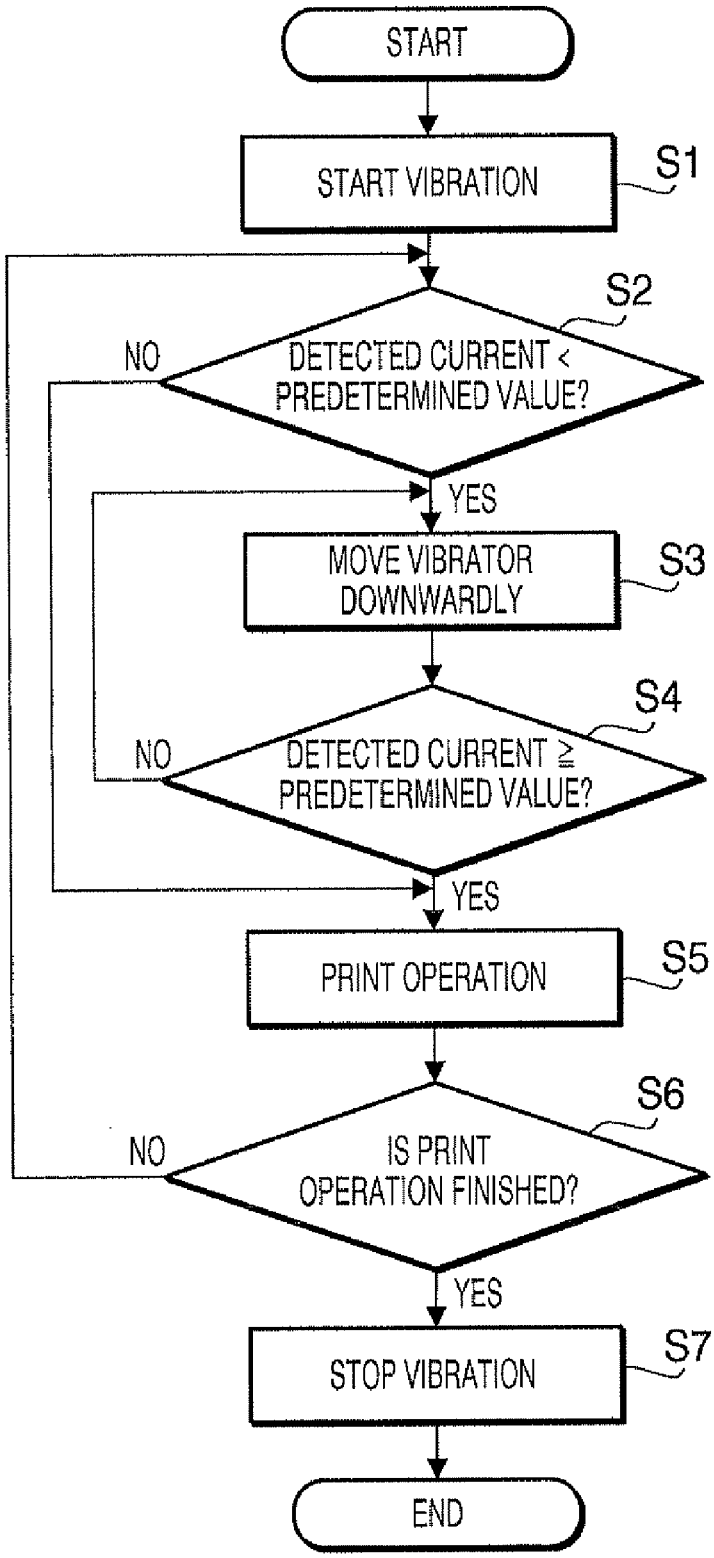
FIG. 7 is a flowchart illustrating a control process executed under control of a controller according to the first embodiment.

FIG. 7 is a flowchart illustrating a control process executed under control of the controller 8. For example, the controller 8 is a microcomputer chip including a CPU, a ROM and a RAM. The controller 8 has functions of driving internal components of the laser beam printer 1, controlling an alternating voltage to be supplied to the toner carrying unit 73, controlling the moving unit 75 in accordance with a signal from the current sensor AS (see FIG. 5B) to control the position of the vibrator 74 in response to the amount of toner T.

It is possible to set an initial position of the vibrator 74 by selecting a position from among various positions along a moving path of the vibrator. For example, regarding up and down control of the position of the vibrator 74, a position corresponding to the top surface TF of the toner T defined when the maximum amount of the toner T is accumulated in the cartridge case 71 or a position higher than the position corresponding to the top surface TF may be defined as the initial position of the vibrator 74.

As shown in FIG. 7, when the controller 8 receives a print command, for example, from a user, the control process is started. First, the controller 8 applies an alternating voltage to the vibrator 74 to vibrate the vibrator 74 (step S1). The print command may be inputted to the controller 8 through an operation panel mounted on an outer surface of the laser beam printer 1 or may be externally inputted to the controller 8 through a computer connected to the laser beam printer 1. The print command includes setting information, such as setting of the number of copies.

After step S1 is processed, the controller 8 judges whether the vibrator 74 is at a position shifted from the position corresponding to the top surface of the toner T, by judging whether the current detected by the current sensor AS is lower than a predetermined value in accordance with a signal from the current sensor AS (step S2).

If the controller 8 judges that the current is lower than the predetermined value (i.e., the vibrator 74 is at a position shifted from the top surface of the toner T (S2: YES), the controller 8 controls the moving unit 75 to move the vibrator 74 downwardly in a slanting direction by a predetermined distance (step S3). Then, the controller 8 judges whether the vibrator 74 has reached the position of the top surface of the toner T by judging whether the detected current has become larger than or equal to the predetermined value (step S4).

If the controller 8 judges that the detected current has not become larger than or equal to the predetermined value (S4: NO), control returns to step S3 to move the vibrator 74 by the predetermined distance again. If the controller 8 judges that the detected current has become larger than or equal to the predetermined value (S4: YES), control proceeds to step S5 where the controller 8 executes a print operation. If the controller 8 judges that the detected current is not lower than the predetermined value (S2: NO), control also proceeds to step S5 where the print operation is executed.

After step S5 is processed, the controller 8 judges whether the print operation has been finished for the setting of the number of copies designated in the print command (step S6). If the controller 8 judged that the print operation has not finished for the setting of the number of copies (S6; NO), control returns to step S2 to judge again whether the vibrator 74 is shifted from the position corresponding to the top surface of the toner T.

If the controller 8 judges that the print operation has finished for the setting of the number of copies (S6: YES), the controller 8 stops applying the alternating voltage to the vibrator 74 (step S7). Then, the control process terminates.

Figure 8A:
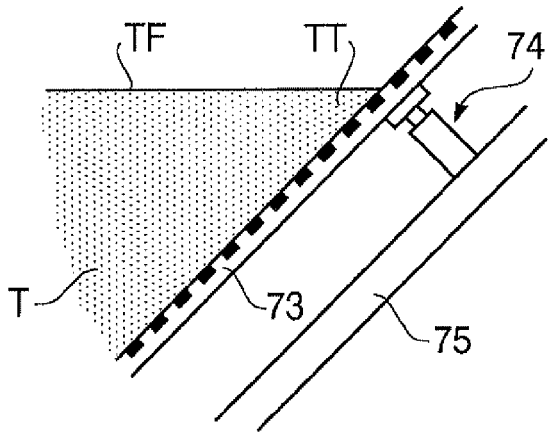
FIG. 8A illustrates a situation where the vibrator is at the position corresponding to the top surface of the toner.
Figure 8B:
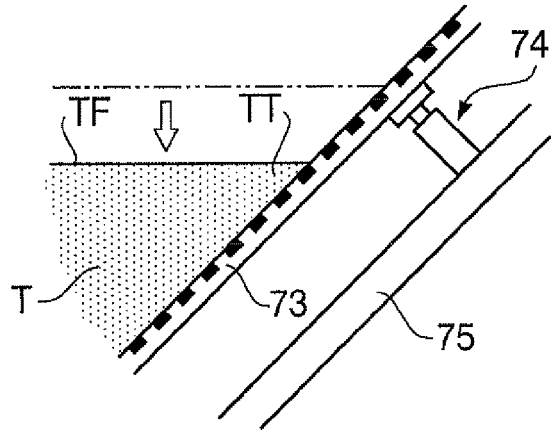
FIG. 8B illustrates a situation where the top surface of the toner is lowered with respect to the situation shown in FIG. 8A.
Figure 8C:
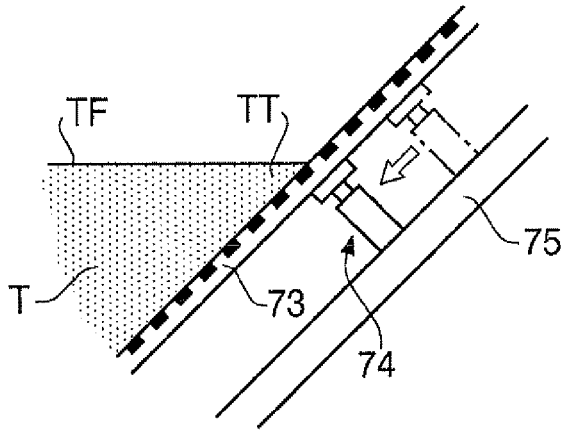
FIG. 8C illustrates a situation where the vibrator is being moved to the position corresponding to the top surface of the toner.

Hereafter, operation of the toner supplying device 7 is explained. FIGS. 8A to 8C are explanatory illustrations for explaining the control of the position of the vibrator 74 executed under control of the controller 8 through the control process shown in FIG. 7. More specifically, FIG. 8A illustrates a situation where the vibrator 74 is at the position corresponding to the top surface of the toner T, FIG. 8B illustrates a situation where the top surface of the toner T is lowered with respect to the situation shown in FIG. 8A, and FIG. 5C illustrates a situation where the vibrator 74 is being moved to the position corresponding to the top surface of the toner T.

As shown in FIG. 8A, when the vibrator 74 is at the position corresponding to the top surface of the toner T at the time when the print command is inputted to the controller 8, the controller 8 executes steps S1, S2 (S2: NO) and S5 in this order. In this case, a part TT (hereafter, frequently referred to as a toner picking up part TT) from which the toner T is carried by the toner carrying unit 73 is suitably collapsed by vibration of the vibrator 74. Then, the toner T is appropriately carried by the toner carrying unit 73. As a result, the print operation can be executed appropriately.

Until the print operation for the setting of the number of copies designated in the print command is finished, the controller 8 repeats execution for steps S2 to S6. when the top surface of the toner T is lowered due to decrease of the toner T during the print operation, the detected current flowing through the vibrator 74 decreases due to decrease of the load acting on the vibrator 74. When the detected current becomes lower than the predetermined value, the judgment result made by the controller 8 in step S2 becomes "YES", and then the controller 8 executes steps S3 and S4.

As a result, the vibrator 74 moves to the position corresponding to the top surface of the toner T. After the vibrator 74 has moved to the position corresponding to the top surface of the toner T, the controller 8 executes steps S4 (S4. YES) and S5. Consequently, the toner T is collapsed appropriately, and the toner T is carried appropriately.

According to the above described first embodiment, the following advantages are achieved. Since the vibrator 74 is controlled to follow the toner picking up part TT of the toner T, agglutination of the toner T at the toner picking up part TT in the toner carrying unit 73 can be effectively prevented. Therefore, it becomes possible to carry the toner T smoothly.

Since the controller 8 is able to precisely detect the top surface of the toner T through the current sensor AS and the coil 74B, it is possible to move the vibrator 74 to the position of the toner picking up part TT appropriately. In addition, since the coil 74B functioning as a part of the vibrator 74 can be used as a sensor for detecting the top surface of the toner T, it is possible to share a part for different purposes. Therefore, cost reduction can be achieved.

Since the second carrying unit 73B which is a target for vibration forms a part of the cartridge case 71, it is possible to locate the vibrator 74 outside the cartridge case 71.

Second Embodiment

Hereafter, a laser beam printer according to a second embodiment is described. A laser beam printer according to the second embodiment is a variation of the laser beam printer 1 achieved by changing a partial structure around the toner supplying device 7. Therefore, in FIGS. 9 and 10, to elements which are substantially the same as those of the first embodiment, the same reference numbers are assigned, and explanations thereof will not be repeated. In the following, the explanation focuses on the feature of the second embodiment.

Figure 9:
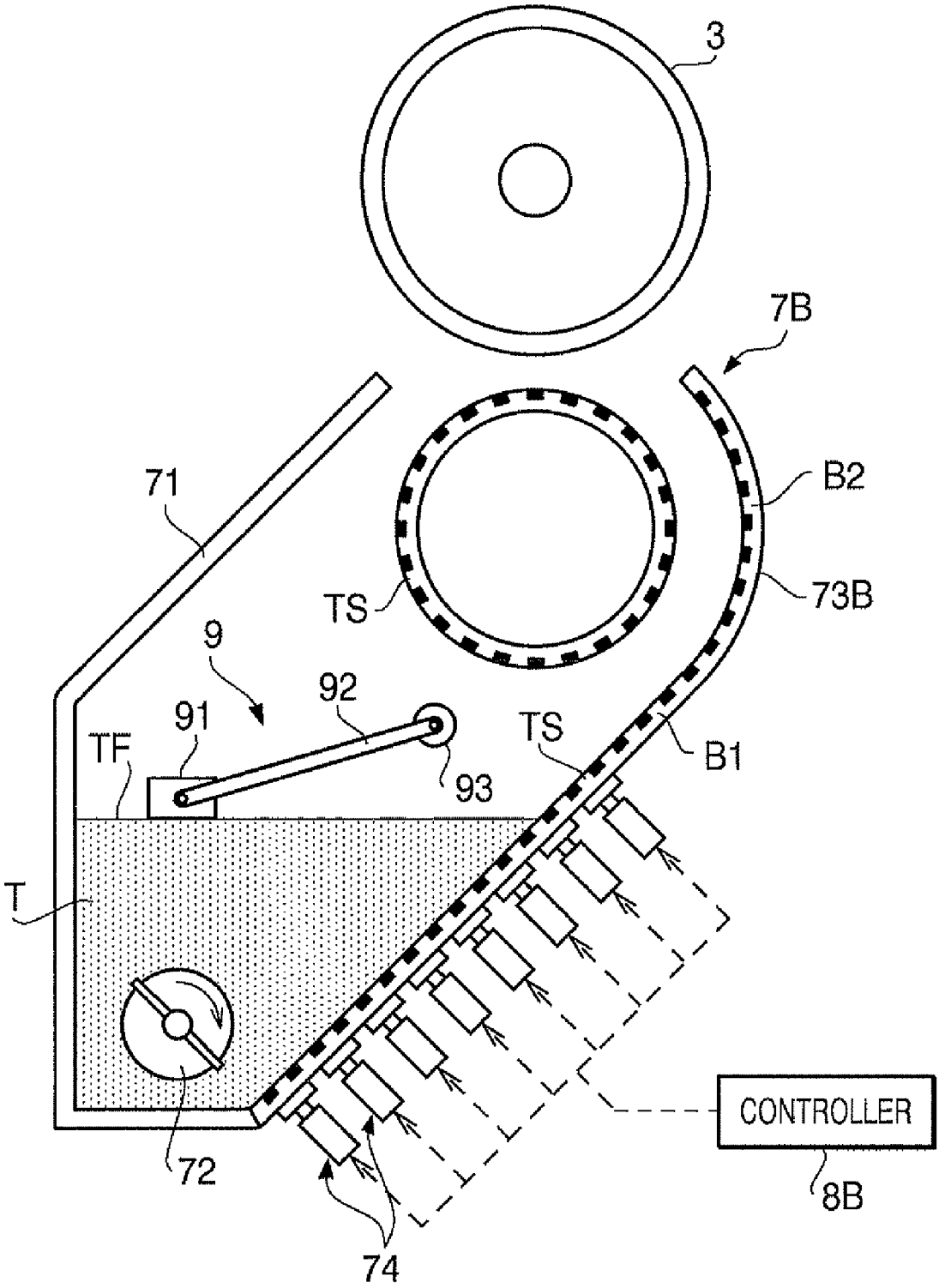
FIG. 9 is a cross section illustrating a structure of a toner carrying device according to a second embodiment.
Figure 10:
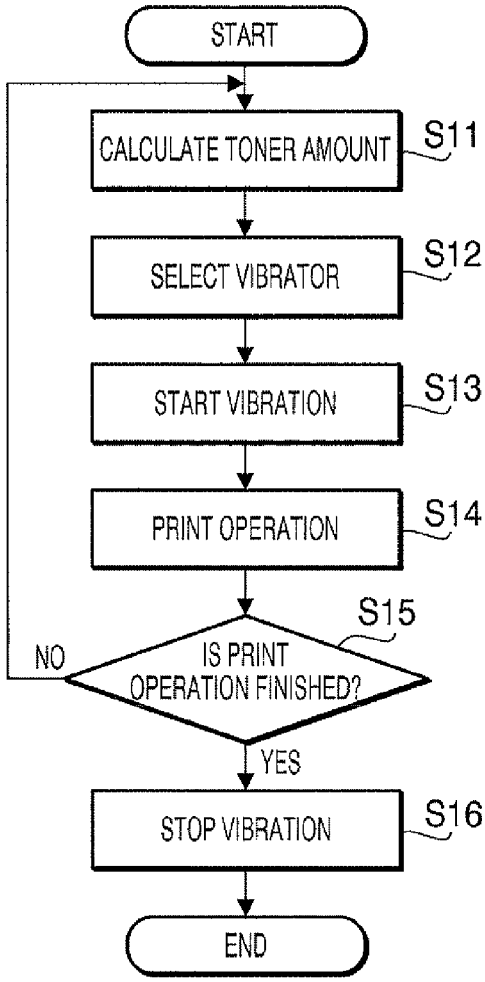
FIG. 10 illustrates a control process executed under control of a controller according to the second embodiment.

FIG. 9 is a cross section illustrating a structure of a toner carrying device 7B according to the second embodiment. FIG. 10 illustrates a control process executed under control of a controller 8B according to the second embodiment.

In contrast to the toner carrying device 7 according to the first embodiment, the toner carrying unit 7B includes a plurality of vibrators 74 and the controller 8B. In this embodiment, a top surface detection sensor 9 which mechanically detects the top surface of the toner T is provided.

The vibrators 74 are arranged along the tilting part B1 of the second carrying unit 73B at predetermined intervals.

More specifically, the vibrators 74 are arranged along the direction in which the toner T is carried.

The top surface detection sensor 9 includes a float 91 placed on the top surface TF of the toner T, a swinging arm 92 and an angle sensor 93. The swinging arm 92 is configured such that one end thereof rotatably supports the float 91 and the other end thereof is rotatably attached to the cartridge case 71. The angle sensor 93 detects the angle of the swinging arm 92. A signal representing the angle detected by the top surface detection sensor 9 is sent to the controller 8B.

The controller 8B calculates the amount of toner T based on the signal from the top surface detection sensor 9, and selectively sends a signal to the vibrators 74 in accordance with the calculated amount of toner T so that one vibrator 74 located at the top surface of the toner T or two vibrators 74 between which the top surface of the toner T is situated is vibrated. Hereafter, such one or two vibrators 74 to be vibrated are expressed by a simple expression, such as "one or two vibrators 74 located at the top surface of the toner T". That is, the controller 8B selectively vibrates one or two of the vibrators 74 so that a vibrating region vibrated by the one or two of the vibrators 74 moves along the toner carrying unit 73. Such control for moving the vibrating region can be achieved by executing a control process shown in FIG. 10.

FIG. 10 is a flowchart illustrating the control process executed under control of the controller 8B according to the second embodiment.

The control process shown in FIG. 10 is started when the controller 8B receives a print command, for example, from a user. First, the controller 8B calculates an amount of toner T based on the signal from the top surface detection sensor 9 (step S11). Then, the controller 8B selects one or two vibrator (74) located at the calculated position of the top surface of the toner T (step S12). The relationship between an amount of toner T and corresponding one or two vibrators (74) to be selected may be defined, as map data, in advance by experiment or by simulation.

After step S12 is thus processed, the controller 8B applies a alternating voltage to the selected one or two vibrators 74 to vibrate the selected one or two vibrators 74 (step S13). Then, the controller 8B executes the print operation (step S14). After step S14 is processed, the controller 8B judges whether the print operation is finished for the setting of the number of copies designated in the print command (step S15).

If the controller 8B judges that the print operation is not finished (S15: NO), control returns to step S11. If the controller 8B judges that the print operation is finished (S15: YES), the controller 8B stops to apply the alternating voltage to stop vibration of the selected one or two vibrators 74 (step S16). Then, the control process shown in FIG. 10 terminates.

If the control process is executed under the state of the top surface of the tone T shown in FIG. 9, one vibrator 74 (i.e., the second one from the topmost vibrator) located at the top surface of the toner T is selected as a vibrator to be vibrated. However, the number of vibrators to be vibrated is not limited to one or two, and a desired number of vibrators may be selected as vibrators to be vibrated. For example, three or four vibrators 74 situated near the top surface of the toner T may be selected as vibrators to be vibrated (i.e., vibrators to form the vibrating region).

The laser beam printer according to the second embodiment is able to achieve the following advantages in addition to achieving the same advantages as those of the first embodiment.

According to the second embodiment, it is not necessary to provide the vibrator 74 to be slidable on the toner carrying unit 73. Therefore, the wearing away of the toner carrying unit 73 can be prevented.

Since only a part of the vibrators 74 selected from all of the plurality of vibrators 74 is vibrated, it is possible to prevent noise from being produced.

Although the present invention has been described in considerable detail with reference to certain preferred embodiments thereof, other embodiments are possible.

Figure 11:
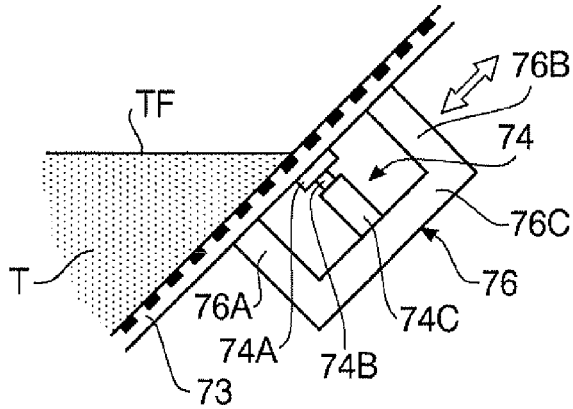
FIG. 11 is a cross section illustrating a situation where a vibration suppressing material is attached to the vibrator.

In the above described first embodiment, only the vibrator 74 is mounted in the laser beam printer 1 to be slidable with respect to the toner carrying unit 73. However, a vibration suppressing member may be mounted in the laser beam printer 1 to be slidable with respect to the toner carrying unit 73, together with the vibrator 74. FIG. 11 illustrates such an example. In the example shown in FIG. 11, a vibration suppressing member 76 having a form of a letter "U" is mounted in the laser beam printer 1 to be slidable with respect to the toner carrying unit 73, together with the vibrator 74. More specifically, the vibration suppressing member 76 includes a front vibration suppressing part 76A, a rear vibration suppressing part 7613 and a bottom part 76C. The front vibration suppressing part 76A is situated on the front side along a moving path of the vibrator 74 and contacts the toner carrying unit 73. The rear vibration suppressing part 76B is situated on the rear side along the moving path of the vibrator 74 and contacts the toner carrying unit 73.

In this configuration, the vibration produced by the vibrator 74 is prevented from propagating toward the outside of the front and rear vibration suppressing parts 76A and 76B. Therefore, it becomes possible to maintain the vibration condition of the toner carrying unit 73 defined between the front and rear vibration suppressing parts 76A and 76B at a constant level regardless of the position of the vibrator 74. As a result, it is possible to precisely detect the top surface of the toner T. Regarding the example shown in FIG. 11, the vibration suppressing member 76 may be formed integrally with the core 74C of the vibrator 74. Various types of materials may be employed for the material of the vibration suppressing member 76. It is desirable that the vibration suppressing member 76 may be made of material having a higher degree of rigidity than that of the toner carrying unit 73. It is preferable that the material of the vibration suppressing member 76 has a relatively heavy weight.

In the first embodiment, the current sensor AS is used as a detection sensor for detecting the top surface of toner. However, various types of sensor, such as a voltage sensor, may be employed as a detection sensor for detecting the top surface of toner.

In the case where a voltage sensor is used as a detection sensor for detecting the top surface of toner, the controller 8 may execute constant current control for an alternating bias applied to the coil 74B. In this case, the voltage applied to the coil 74B changes depending on the load acting on the coil 74B. Therefore, the position corresponding to the top surface of toner can be detected.

The current sensor or the voltage sensor may be accommodated in the controller 8.

In the above described embodiments, a photosensor may be employed as a detection unit for detecting the position of the top surface of toner.

In the first embodiment, the vibrator 74 is mounted in the laser beam printer 1 such that the core 74C is fixed to a body (i.e., the moving unit 75) of the laser beam printer 1 so that the coil 74B is allowed to vibrate with respect to the core 74C. However, the vibrator 74 may be mounted in the laser beam printer 1 such that the coil 74B is fixed to the body of the laser beam printer 1 so that the core 74C is allowed to vibrate with respect to the coil 74B.

In the first embodiment, the controller 8 controls the vibrator 74 to vibrate constantly during the print operation as shown in FIG. 7. However, such a control process may be changed such that the vibrator 74 is controlled to stop vibration during the print operation. As a variation of the control process shown in FIG. 7, FIG. 12 illustrates a control process configured to stop vibration during the print operation.

Figure 12:
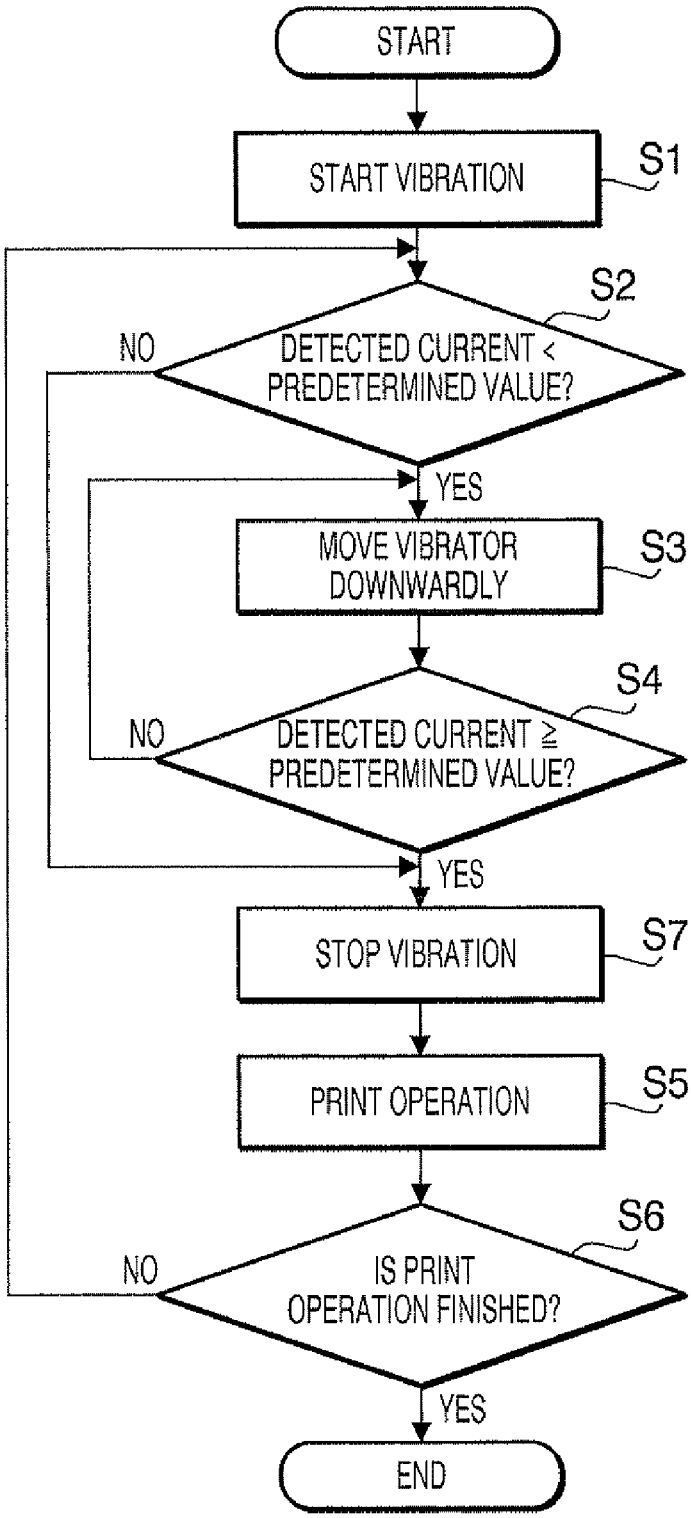
FIG. 12 illustrates a control process configured to stop vibration during a print operation.

The control process shown in FIG. 12 can be achieved by changing partially the control process shown in FIG. 7 in such a manner that step S7 for stopping vibration is moved to the position before step S5 and control returns to step S1 when the judgment result of step S6 is "NO". For example, through the control process shown in FIG. 12, vibration of the vibrator 74 is controlled to stop while the print operation for one copy is executed in step S5.

In the first embodiment, the vibrator 74 is controlled to move downwardly in a slanting direction. However, the vibrator 74 may be controlled to move upwardly in a slanting direction. In this case, a sensor for detecting replenishment of toner may be provided in the laser beam printer, and the vibrator 74 may be controlled to move upwardly in a slanting direction based on an output from the sensor for detecting replenishment of toner.

In the above described embodiments, the toner picking up part TT is defined as a vibration region to be vibrated by the vibrator 74. However, if the toner T around the toner picking up part TT can be suitably collapsed by vibrating the toner T at a position shifted by a predetermined distance from the position of the toner picking up part TT, the vibrating region may be controlled such that the vibrating region is constantly located at the position shifted by the predetermined distance from the toner picking up part TT.

In the above described embodiment, a photosensitive drum is employed as a target to which the developing material is supplied. However, a different type of component (e.g., a developing roller) may be targeted for supply of the developing material.

In the above described embodiment, a vibrator formed as combination of a coil and a core is adopted. However, various types of vibrating members, such as a piezoelectric element, may be adopted as the vibrator 74.

In the above described embodiments, the position of the top surface of toner is estimated based on the signal from the detecting unit. However, various types of technique may be employed for estimating the position of the top surface of toner. For example, the position of the top surface of toner may be estimated in accordance with the remaining amount of toner which is estimated from the number of printed copies.

Alternatively, the position of the top surface of toner may be optically detected. For example, a photosensor having a light emission part and a photoreceptor is provided in the laser beam printer. In this case, the light emission part emits light along the top surface of toner and the photoreceptor receives the light emitted by the light emission part. Based on the amount of received light which varies depending on the amount of toner, the position of the top surface of toner can be estimated.

In the above described embodiments, a member to be vibrated by the vibrator 74 (i.e., the second toner carrying unit 73B) is formed as a part of the cartridge case 71. However, a member to be vibrated by the vibrator 74 may be placed in the inside of the cartridge case 71.

In the above described embodiments, the vibrator 74 is moved along the moving direction of the toner T, or the plurality of vibrators are aligned along the moving direction of the toner T. However, the vibrator 74 may be moved in a slanting direction with respect to the moving direction of the toner T or the plurality of vibrators 74 may be aligned along a slanting direction with respect to the moving direction of the toner T.

In the above described embodiments, the control process is implemented on the laser beam printer 1. However, the control process may be implemented on various types of image forming devices, such as a copying device or a multifunction peripheral.

In the above described embodiments, a photosensitive drum is adopted as an image holding unit. However, a photosensitive member having a form of a belt may be adopted as n image holding unit.

In the above described embodiments, the toner T having a negative electrostatic property is adopted as developing material. However, toner having a positive electrostatic property (i.e., toner charged positively) may be adopted as developing material. In this case, the internal components to be charged including the photosensitive drum 3 are charged inversely.

What is claimed is:

1. An image forming device, comprising:

an image holding unit configured to hold an image formed by developing material;

a developing material case configured to accommodate the developing material and to have a supplying opening facing the image holding unit;

a carrying unit having a plurality of carrying electrodes, the carrying unit being configured to carry the developing material accommodated in the developing material case toward the image holding unit by generating a traveling electric field through the plurality of carrying electrodes;

at least one vibrator that vibrates the carrying unit; and a vibrating region moving unit configured to move a vibrating region vibrated by the at least one vibrator along the carrying unit in accordance with an amount of the developing material in the developing material case.

2. The image forming device according to claim 1, wherein:

the vibrating region moving unit comprises:

a moving unit configured to move the at least one vibrator along the carrying unit; and a controller that controls the moving unit in accordance with the amount of the developing material in the developing material case such that the at least one vibrator is situated at a position corresponding to a top surface of the developing material.

3. The image forming device according to claim 2, further comprising a vibration suppressing member having first and second contact parts contacting the carrying unit on a front side and a rear side with respect to the at least one vibrator, respectively, wherein the vibration suppressing member prevents vibration of the carrying unit from propagating to an outside of the vibration suppressing member.

4. The image forming device according to claim 2, further comprising a detection unit configured to detect the top surface of the developing material in the developing material case, wherein the controller executes control based on an output signal from the detection unit.

5. The image forming device according to claim 4, wherein:

the at least one vibrator includes a permanent magnet and a coil which generates a magnetic field in an energized state;

the at least one vibrator is mounted in the image forming device such that one of the permanent magnet and the coil is vibrated; and the detection unit includes a current sensor which detects a current flowing through the coil.

6. The image forming device according to claim 4, wherein:

the at least one vibrator includes a permanent magnet and a coil which generates a magnetic field in an energized state;

the at least one vibrator is mounted in the image forming device such that one of the permanent magnet and the coil is vibrated; and the detection unit includes a voltage sensor which detects a voltage being applied to the coil.

7. The image forming device according to claim 2 wherein the at least one vibrator is slidably attached to the carrying unit.

8. The image forming device according to claim 2 wherein, the controller stops the vibration during the print operation.

9. The image forming device according to claim 2 wherein, the controller causes movement downward when the material is used.

10. The image forming device according to claim 2 wherein, the controller causes movement upward when material is being replenished.

11. The image forming device according to claim 1, wherein:

the at least one vibrator comprises a plurality of vibrators arranged along the carrying unit; and the vibrating region moving unit comprises a controller that selectively vibrates the plurality of vibrators such that one or more vibrators which are selected from the plurality of vibrators and are located at positions corresponding to a top surface of the developing material are vibrated as the vibrating region.

12. The image forming device according to claim 11 further comprising a detection unit configured to detect the top surface of the developing material in the developing material case, wherein the controller executes control based on an output signal from the detection unit.

13. The image forming device according to claim 1, wherein the carrying unit forms a part a wall of the developing material case.

14. A developing material carrying device, comprising:

a developing material case configured to accommodate developing material and to have a supplying opening facing a supply target to which the developing material is supplied;

a carrying unit having a plurality of carrying electrodes, the carrying unit being configured to carry the developing material accommodated in the developing material case toward the supply target by generating a traveling electric field through the plurality of carrying electrodes;

a vibrator that vibrates the carrying unit; and a moving unit configured to move the vibrator along the carrying unit.

15. A developing material carrying device, comprising:

a developing material case configured to accommodate developing material and to have a supplying opening facing a supply target to which the developing material is supplied;

a carrying unit having a plurality of carrying electrodes, the carrying unit being configured to carry the developing material accommodated in the developing material case toward the supply target by generating a traveling electric field through the plurality of carrying electrodes;

a plurality of vibrators that are arranged along the carrying unit to vibrate the carrying unit; the plurality of vibrators being configured to be selectively vibrated in accordance with the amount of developing material in the developing material case.

16. The developing material carrying device according to claim 15, wherein the plurality of vibrators are arranged in a direction where the developing material is carried.

* * * * *